US008397436B2

(12) United States Patent
Higginbotham

(10) Patent No.: US 8,397,436 B2
(45) Date of Patent: Mar. 19, 2013

(54) SELF CLEANING SHIELD

(75) Inventor: Edward A. Higginbotham, Ridgewood, NJ (US)

(73) Assignee: MGP Manufacturing, LLC, Paramus, NJ (US)

( * ) Notice: Subject to any disclaimer, the term of this patent is extended or adjusted under 35 U.S.C. 154(b) by 0 days.

(21) Appl. No.: 13/065,454

(22) Filed: Mar. 23, 2011

(65) Prior Publication Data

US 2011/0253611 A1 Oct. 20, 2011
US 2013/0020241 A9 Jan. 24, 2013

Related U.S. Application Data

(63) Continuation of application No. 11/698,879, filed on Jan. 29, 2007, now Pat. No. 7,913,458, which is a continuation-in-part of application No. 10/849,913, filed on May 21, 2004, now Pat. No. 7,191,564.

(51) Int. Cl.
*E04D 13/00* (2006.01)

(52) U.S. Cl. ..... 52/12; 52/11; 52/15

(58) Field of Classification Search ..... 52/12, 11, 52/15, 248; 248/41.1, 41.2
See application file for complete search history.

(56) References Cited

U.S. PATENT DOCUMENTS

| | | | | |
|---|---|---|---|---|
| 297,382 | A | 4/1884 | Golding | |
| 546,042 | A | 9/1895 | Van Horn | |
| 1,101,047 | A | 6/1914 | Yates | |
| 1,562,191 | A | 11/1925 | Reno | |
| 2,209,741 | A | 7/1940 | Sullivan et al. | |
| 2,210,248 | A | 8/1940 | Lighthill | |
| 2,271,081 | A * | 1/1942 | Layton | 52/12 |
| 2,672,832 | A | 3/1954 | Goetz | |
| 2,717,561 | A | 9/1955 | Bearden | |
| 2,935,954 | A | 5/1960 | Matthews et al. | |
| 3,057,481 | A | 10/1962 | Ball | |
| 3,167,281 | A * | 1/1965 | Hill | 245/8 |
| 3,426,909 | A | 2/1969 | Garner | |
| 3,690,606 | A | 9/1972 | Pall | |
| 3,741,398 | A | 6/1973 | Abramson | |
| 3,855,132 | A | 12/1974 | Dugan | |
| 4,050,104 | A | 9/1977 | Baker | |
| 4,727,689 | A | 3/1988 | Bosler | |
| 4,745,710 | A | 5/1988 | Davis | |
| 4,757,649 | A | 7/1988 | Vahldieck | |
| 4,820,407 | A | 4/1989 | Lilie | |
| 4,841,686 | A | 6/1989 | Rees | |

(Continued)

FOREIGN PATENT DOCUMENTS

| | | | |
|---|---|---|---|
| GB | 2351757 | A | 1/2001 |
| JP | 1-304254 | A | 12/1989 |

(Continued)

OTHER PUBLICATIONS

Flo-Free Web Advertisement, 2 pages.

(Continued)

*Primary Examiner* — William Gilbert
*Assistant Examiner* — Patrick Maestri
(74) *Attorney, Agent, or Firm* — Venable LLP; Jeffri A. Kaminski; Ryan M. Flandro

(57) ABSTRACT

A gutter shield device comprising a first body portion and a second body portion laterally bordering an intermediate body portion that includes a perforated plane out of which arises upward protruding elements that contact the undersurface of a micro-mesh or screen filter comprised of eighty or more threads per inch. The gutter shield includes on the bottom of it's perforated plane at least one downwardly extending element to interdict and redirect downward any forward flowing water present on the underside of the perforated plane.

6 Claims, 10 Drawing Sheets

U.S. PATENT DOCUMENTS

| | | | | |
|---|---|---|---|---|
| 4,904,288 | A | 2/1990 | d'Augereau | |
| 4,937,986 | A | 7/1990 | Way, Sr. et al. | |
| 4,949,514 | A | 8/1990 | Weller | |
| 4,959,932 | A | 10/1990 | Pfeifer | |
| 5,010,696 | A * | 4/1991 | Knittel | 52/12 |
| 5,040,750 | A | 8/1991 | Brant | |
| 5,044,581 | A | 9/1991 | Dressler | |
| 5,072,551 | A | 12/1991 | Manoogian, Jr. | |
| 5,107,635 | A | 4/1992 | Carpenter | |
| 5,181,350 | A | 1/1993 | Meckstroth | |
| 5,257,482 | A | 11/1993 | Sichel | |
| 5,271,192 | A | 12/1993 | Nothum, Sr. et al. | |
| 5,388,377 | A | 2/1995 | Faulkner | |
| 5,406,754 | A | 4/1995 | Cosby | |
| 5,459,350 | A | 10/1995 | Date et al. | |
| 5,459,965 | A | 10/1995 | Meckstroth | |
| 5,491,998 | A | 2/1996 | Hansen | |
| 5,495,694 | A | 3/1996 | Kuhns | |
| 5,555,680 | A | 9/1996 | Sweers | |
| 5,557,891 | A | 9/1996 | Albracht | |
| 5,592,783 | A | 1/1997 | Jones | |
| 5,595,027 | A | 1/1997 | Vail | |
| 5,617,678 | A * | 4/1997 | Morandin et al. | 52/11 |
| 5,619,825 | A | 4/1997 | Leroney et al. | |
| 5,619,826 | A | 4/1997 | Wu | |
| 5,640,809 | A | 6/1997 | Iannelli | |
| 5,660,001 | A | 8/1997 | Albracht | |
| 5,755,061 | A | 5/1998 | Chen | |
| 5,813,173 | A | 9/1998 | Way, Sr. | |
| 5,842,311 | A | 12/1998 | Morin | |
| 5,956,904 | A | 9/1999 | Gentry | |
| 6,016,631 | A | 1/2000 | Lowrie, III | |
| 6,098,344 | A | 8/2000 | Albracht | |
| 6,134,843 | A | 10/2000 | Tregear | |
| 6,151,837 | A | 11/2000 | Ealer, Sr. | |
| 6,161,338 | A | 12/2000 | Kuhns | |
| 6,164,020 | A | 12/2000 | Nitch | |
| 6,182,399 | B1 | 2/2001 | Pollera | |
| 6,205,715 | B1 | 3/2001 | Rex, Jr. | |
| 6,363,662 | B1 | 4/2002 | Coates | |
| 6,367,743 | B1 | 4/2002 | Iannelli | |
| 6,412,228 | B1 | 7/2002 | Meckstroth | |
| 6,463,700 | B2 | 10/2002 | Davis | |
| 6,598,352 | B2 * | 7/2003 | Higginbotham | 52/12 |
| 6,672,012 | B2 | 1/2004 | Bahroos et al. | |
| 6,944,991 | B2 | 9/2005 | Kim | |
| 6,951,077 | B1 * | 10/2005 | Higginbotham | 52/12 |
| 7,174,688 | B2 | 2/2007 | Higginbotham | |
| 7,310,912 | B2 | 12/2007 | Lenney et al. | |
| 7,344,636 | B2 | 3/2008 | Faram et al. | |
| 7,765,742 | B2 * | 8/2010 | Ealer, Sr. | 52/12 |
| 2001/0037610 | A1 * | 11/2001 | Davis | 52/12 |
| 2003/0046876 | A1 | 3/2003 | Higginbotham | |
| 2005/0257432 | A1 | 11/2005 | Higginbotham | |
| 2006/0101722 | A1 | 5/2006 | Ealer | |
| 2006/0179723 | A1 * | 8/2006 | Robins | 52/11 |
| 2007/0107323 | A1 | 5/2007 | Higginbotham | |
| 2007/0215539 | A1 | 9/2007 | Conroy | |

FOREIGN PATENT DOCUMENTS

| | | | |
|---|---|---|---|
| JP | 11-100953 | A | 4/1999 |
| JP | 2001-349022 | A | 12/2001 |
| JP | 2002-061348 | A | 2/2002 |
| KR | 2005079662 | A | 8/2005 |
| WO | WO-95/02100 | A1 | 1/1995 |

OTHER PUBLICATIONS

Gutter Helmet Web Advertisement, 1 page.
Sheer Flow Web Advertisement, 1 page.
Miami Aqua-Culture, Inc., Polyester & Nylon Screening, Jan. 26, 2000, pp. 10, 20, 30, 40.
Permaflow Gutter Guard System Installation, Crane Products Ltd., pp. 10, 20, 30, 40, 50, 60, 70.
K-Guard Web Advertisement, 1 page.
Englert Leaf Guard Web Advertisement, 1 page.

* cited by examiner

SELF CLEANING SHIELD

CROSS-REFERENCE TO RELATED APPLICATIONS

This application is a continuation application of U.S. application Ser. No. 11/698,879, filed Jan. 29, 2007, now U.S. Pat. No. 7,913,458, issued Mar. 29, 2011, which is a continuation-in-part of U.S. patent application Ser. No. 10/849,913, filed May 21, 2004, now U.S. Pat. No. 7,191,564, issued Mar. 20, 2007.

BACKGROUND

1. Field of Invention

Gutter covering systems are known to prevent debris from entering into the open top end of a rain gutter. When debris accumulates within the body of a rain gutter in an amount great enough to cover the opening of a downspout-draining hole, the draining of water from the rain gutter is impeded or completely stopped. This occurrence will cause the water to rise within the rain gutter and spill over its uppermost front and rear portions.

The purpose of a rain gutter, to divert water away from the structure and foundation of a home, is thereby circumvented.

2. Related Art

The invention relates to the field of Gutter Anti-clogging Devices and particularly relates to screens with affixed fine filter membranes, and to devices that employ recessed wells or channels in which filter material may be inserted, affixed to gutters to prevent debris from impeding the desired drainage of water.

Various gutter anti-clogging devices are known in the art and some are described in issued patents.

In my U.S. Pat. No. 6,598,352, I teach a gutter protection system for preventing entrance of debris into a rain gutter. I teach a gutter protection system to include a recessed perforated angled well within a rigid main body that receives an insertable flexible polymer support skeleton that supports overlying micro mesh filtering membrane that is attached to the underlying support skeleton. This insertable flexible filtration configuration is manufactured separately from the rigid four or five foot length body in fifty foot rolls and allows for a seamless filter protecting an underlying gutter, over long gutter lengths. The insertable support skeleton includes a perforated plane with integral downward extending planes and integral upward extending support planes, separated by unbroken air space, that contact an overlying micro mesh filtering membrane on it's undermost surface. I further teach that the contacting of the undermost surface of a micromesh filtering membrane by optimally spaced support planes encourages the downward flow of rain water through said micro mesh filtering membrane and into an underlying rain gutter. This gutter protection system has been shown, in the field to be extremely effective at preventing rain gutter clogs without a single known instance of clogging. However, the insertable flexible polymer support skeleton with attached filtering membrane is somewhat heavy and has been found to be cumbersome, even impossible, to install in the recessed angled well of the rigid main body of the gutter protection system during cold weather as the flexible polymer skeleton has been found to stiffen and becomes inflexible. The insertable flexible skeleton also has been known to expand and contract at a different coefficient that rigid main body of the gutter protection system. This can cause areas of the main body of the gutter protection to become exposed to potential debris entrance due to relative shrinkage of the insertable polymer support skeleton or, in other instances, the insertable filtration configuration may expand and extend past the main body of the gutter protection system and further expand past end caps of an underlying gutter which home owners view as undesirable from a cosmetic perspective.

U.S. Pat. No. 5,557,891 to Albracht teaches a gutter protection system for preventing entrance of debris into a rain gutter. Albracht teaches a gutter protection system to include a single continuous two sided well with angled sides and perforated bottom shelf 9 into which rainwater will flow and empty into the rain gutter below. The well is of a depth, which is capable of receiving a filter mesh material. However, attempts to insert or cover such open channels of "reverse-curve" devices with filter meshes or cloths is known to prevent rainwater from entering the water receiving channels. This occurrence exists because of the tendency of such membranes, (unsupported by a proper skeletal structure), to channel water, by means of water adhesion along the interconnected paths existing in the filter membranes (and in the enclosures they may be contained by or in), past the intended water-receiving channel and to the ground. This occurrence also exists because of the tendency of filter mediums of any present known design or structure to quickly waterproof or clog when inserted into such channels creating even greater channeling of rainwater forward into a spill past an underlying rain gutter. Filtering of such open, recessed, channels existing in Albracht's invention as well as in U.S. Pat. No. 5,010,696, to Knittel, U.S. Pat. No. 2,672,832 to Goetz, U.S. Pat. No. 5,459,350, & U.S. Pat. No. 5,181,350 to Meckstroth, U.S. Pat. No. 5,491,998 to Hansen, U.S. Pat. No. 4,757,649 to Vahldieck and in similar "reverse-curved" inventions that rely on "reverse-curved" surfaces channeling water into an open channel have been known to disallow entrance of rainwater into the water-receiving channels. Albracht's as well as previous and succeeding similar inventions have therefore notably avoided the utilization of filter insertions. What may appear as a logical anticipation by such inventions at first glance, (inserting of a filter mesh or material into the channel), has been shown to be undesirable and ineffective across a broad spectrum of filtering materials: Employing insertable filters into such inventions has not been found to be a simple matter of anticipation, or design choice of filter medium by those skilled in the arts. Rather, it has proved to be an ineffective option, with any known filter medium, when attempted in the field. Such attempts, in the field, have demonstrated that the filter mediums will eventually require manual cleaning.

U.S. Pat. No. 5,595,027 to Vail teaches a continuous opening 24A between the two top shelves. Vail teaches a gutter protection system having a single continuous well 25, the well having a depth allowing insertion and retention of filter mesh material 26 (a top portion of the filler mesh material capable of being fully exposed at the holes). Vail does teach a gutter protection system designed to incorporate an insertable filter material into a recessed well. However, Vail notably names and intends the filter medium to be a tangled mesh fiberglass five times the thickness of the invention body. This type of filtration medium, also claimed in U.S. Pat. No. 4,841,686 to Rees, and in prior art currently marketed as FLOW-FREE™ is known to trap and hold debris within itself which, by design, most filter mediums are intended to do, i.e.: trap and hold debris. Vail's invention does initially prevent some debris from entering an underlying rain gutter but gradually becomes ineffective at channeling water into a rain gutter due to the propensity of their claimed filter mediums to clog with debris. Though Vail's invention embodies an insertable filter, such filter is not readily accessible for cleaning when such cleaning is necessitated. The gutter cover must be removed and uplifted for cleaning and, the filter medium is not easily and readily inserted replaced into its longitudinal containing channel extending three or more feet. It is often noted, in the field, that these and similar inventions hold fast pine needles in great numbers which presents an unsightly appearance as well as create debris dams behind the upwardly extended and trapped pine needles. Such filter meshes and non-woven lofty fiber mesh materials, even when composed of finer micro-porous materials, additionally tend to clog and fill with oak tassels and other smaller organic debris because they are not resting, by design, on a skeletal structure that encourages greater water flow through its overlying filter membrane than exists when such filter meshes or membranes contact planar continuously-connected surfaces. Known filter mediums of larger openings tend to trap and hold debris. Known filter mediums smaller openings clog or "heal over" with pollen and dirt that becomes embedded and remains in the finer micro-porous filter mediums. At present, there has not been found, as a matter of common knowledge or anticipation, an effective water-permeable, non-clogging "medium-of-choice" that can be chosen, in lieu of claimed or illustrated filter mediums in prior art, that is able to overcome the inherent tendencies of any known filter mediums to clog when applied to or inserted within the types of water receiving wells and channels noted in prior art. Vail also discloses that filter mesh material 26 is recessed beneath a planar surface that utilizes perforations in the plane to direct water to the filter medium beneath. Such perforated planar surfaces as utilized by Vail, by Sweers U.S. Pat. No. 5,555,680, by Morin U.S. Pat. No. 5,842,311 and by similar prior art are known to only be partially effective at channeling water downward through the open apertures rather than forward across the body of the invention and to the ground. This occurs because of the principal of water adhesion: rainwater tends to flow around perforations as much as downward through them, and miss the rain gutter entirely. Also, in observing perforated planes such as utilized by Vail and similar inventions (where rainwater experiences its first contact with a perforated plane) it is apparent that they present much surface area impervious to downward water flow disallowing such inventions from receiving much of the rainwater contacting them. A simple design choice or anticipation of multiplying the perforations can result in a weakened body subject to deformity when exposed to the weight of snow and/or debris or when, in the case of polymer bodies, exposed to summer temperatures and sunlight.

U.S. Pat. No. 4,841,686 to Rees teaches an improvement for rain gutters comprising a filter attachment, which is constructed to fit over the open end of a gutter. The filter attachment comprised an elongated screen to the underside of which is clamped a fibrous material such as fiberglass. Rees teaches in the Background of The Invention that many devices, such as slotted or perforated metal sheets, or screens of wire or other material, or plastic foam, have been used in prior art to cover the open tops of gutters to filter out foreign material. He states that success with such devices has been limited because small debris and pine needles still may enter through them into a rain gutter and clog its downspout opening and or lodge in and clog the devices themselves. Rees teaches that his use of a finer opening tangled fiberglass filter sandwiched between two lateral screens will eliminate such clogging of the device by smaller debris. However, in practice it is known that such devices as is disclosed by Rees are only partially effective at shedding debris while channeling rainwater into an underlying gutter. Shingle oil leaching off of certain roof coverings, pollen, dust, dirt, and other fine debris are known to "heal over" such devices clogging and/or effectively "water-proofing" them and necessitate the manual cleaning they seek to eliminate. (If not because of the larger debris, because of the fine debris and pollutants). Additionally, again as with other prior art that seeks to employ filter medium screening of debris; the filter medium utilized by Rees rests on an inter-connected planar surface which provides non-broken continuous paths over and under which water will flow, by means of water adhesion, to the front of a gutter and spill to the ground rather than drop downward into an underlying rain gutter. Whether filter medium is "sandwiched" between perforated planes or screens as in Rees' invention, or such filter medium exists below perforated planes or screens and is contained in a well or channel, water will tend to flow forward along continuous paths through cur as well as downward into an underlying rain gutter achieving less than desirable water-channeling into a rain gutter.

U.S. Pat. No. 5,956,904 to Gentry teaches a first fine screen having mesh openings affixed to an underlying screen of larger openings. Both screens are elastically deformable to permit a user to compress the invention for insertion into a rain gutter. Gentry, as Rees, recognizes the inability of prior art to prevent entrance of finer debris into a rain gutter, and Gentry, as Rees, relies on a much finer screen mesh than is employed by prior art to achieve prevention of finer debris entrance into a rain gutter. In both the Gentry and Rees prior art, and their improvements over less effective filter mediums of previous prior art, it becomes apparent that anticipation of improved filter medium or configurations is not viewed as a matter of simple anticipation of prior art which has, or could, employ filter medium. It becomes apparent that improved filtering methods may be viewed as patentable unique inventions in and of themselves and not necessarily an anticipation or matter of design choice of a better filter medium or method being applied to or substituted within prior art that does or could employ filter medium. However, though Rees and Gentry did achieve finer filtration over filter medium utilized in prior art, their inventions also exhibit a tendency to channel water past an underlying gutter and/or to heal over with finer dirt, pollen, and other pollutants and clog thereby requiring manual cleaning. Additionally, when filter medium is applied to or rested upon planar perforated or screen meshed surfaces, there is a notable tendency for the underlying perforated plane or screen to channel water past the gutter where it will then spill to the ground. It has also been noted that prior art listed herein exhibits a tendency to allow filter cloth mediums to sag into the opening of their underlying supporting structures. To compensate for forward channeling of water, prior art embodies open apertures spaced too distantly, or allows the apertures themselves to encompass too large an area, thereby allowing the sagging of overlying filter membranes and cloths. Such sagging creates pockets wherein debris tends to settle and enmesh.

U.S. Pat. No. 3,855,132 to Dugan teaches a porous solid material which is installed in the gutter to form an upper barrier surface (against debris entrance into a rain gutter). Though Dugan anticipates that any debris gathered on the upper barrier surface will dry and blow away, that is not always the case with this or similar devices. In practice, such devices are known to "heal over" with pollen, oil, and other pollutants and effectively waterproof or clog the device rendering it ineffective in that they prevent both debris and water from entering a rain gutter. Pollen may actually cement debris to the top surface of such devices and fail to allow wash-off even after repeated rains. U.S. Pat. No. 4,949,514 to Weller sought to present more water receiving top surface of a similar solid porous device by undulating the top surface but, in fact, effectively created debris "traps" with the peak and valley undulation. As with other prior art, such devices may work effectively for a period of time but tend to eventually channel water past a rain gutter, due to eventual clogging of the device itself.

There are several commercial filtering products designed to prevent foreign matter buildup in gutters. For example the FLOW-FREE™ gutter protection system sold by DCI of Clifton Heights, Pa. comprises a 0.75-inch thick nylon mesh material designed to fit within 5-inch K type gutters to seal the gutters and downspout systems from debris and snow buildup. The FLOW-FREE™ device fits over the hanging brackets of the gutters and one side extends to the bottom of the gutter to prevent the collapse into the gutter. However, as in other filtering attempts, shingle material and pine needles can become trapped in the coarse nylon mesh and must be periodically cleaned.

U.S. Pat. No. 6,134,843 to Tregear teaches a gutter device that has an elongated matting having a plurality of open cones arranged in transverse and longitudinal rows, the base of the cones defining a lower first plane and the apexes of the cones defining an upper second plane. Although the Tregear device overcomes the eventual trapping of larger debris within a filtering mesh composed of fabric sufficiently smooth to prevent the trapping of debris he notes in prior art, the Tregear device tends to eventually allow pollen, oil which may leach from asphalt shingles, oak tassels, and finer seeds and debris to coat and heal over a top-most matting screen it employs to disallow larger debris from becoming entangled in the larger aperatured filtering medium it covers. Tregear indicates that filtered configurations such as a commercially available attic ventilation system known as Roll Vent™ manufactured by Benjamin Obdyke, Inc. Warminster, Pa. is suitable, with modifications that accommodate its fitting into a rain gutter. However, such a device has been noted, even in its original intended application, to require cleaning (as do most attic screens and filters) to remove dust, dirt, and pollen that combine with moisture to form adhesive coatings that can scum or heal over such attic filters.

Filtering mediums (exhibiting tightly woven, knitted, or tangled mesh threads to achieve density or "smoothness") employed by Tregear and other prior art have been unable to achieve imperviousness to waterproofing and clogging effects caused by a healing or pasting over of such surfaces by pollen, fine dirt, scum, oils, and air and water pollutants. Additionally, referring again to Tregear's device, a lower first plane tends to channel water toward the front lip of a rain gutter, rather than allowing it's free passage downward, and allow the feeding and spilling of water up and over the front lip of a rain gutter by means of water-adhesion channels created in the lower first plane.

Prior art has employed filter cloths over underlying mesh, screens, cones, longitudinal rods, however such prior art has eventually been realized as unable to prevent an eventual clogging of their finer filtering membranes by pollen, dirt, oak tassels, and finer debris. Such prior art has been noted to succumb to eventual clogging by the healing over of debris which adheres itself to surfaces when intermingled with organic oils, oily pollen, and shingle oil that act as an adhesive. The hoped for cleaning of leaves, pine needles, seed pods and other debris by water flow or wind, envisioned by Tregear and other prior art, is often not realized due to their adherence to surfaces by pollen, oils, pollutants, and silica dusts and water mists. The cleaning of adhesive oils, fine dirt, and particularly of the scum and paste formed by pollen and silica dust (common in many soil types) by flowing water or wind is almost never realized in prior art.

Prior art that has relied on reverse curved surfaces channeling water inside a rain gutter due to surface tension, of varied configurations and pluralities, arranged longitudinally, have been noted to lose their surface tension feature as pollen, oil, scum, eventually adhere to them. Additionally, multi-channeled embodiments of longitudinal reverse curve prior art have been noted to allow their water receiving channels to become packed with pine needles, oak tassels, other debris, and eventually clog disallowing the free passage of water into a rain gutter. Examples of such prior art are seen in the commercial product GUTTER HELMET™ manufactured by American metal products and sold by Mr. Fix It of Richmond, Va. In this and similar Commercial products, dirt and mildew build up on the bull-nose of the curve preventing water from entering the gutter. Also, ENGLERT'S LEAFGUARD®, manufactured and distributed by Englert Inc. of Perthamboy N.J., and K-GUARD®, manufactured and distributed by KNUDSON INC. of Colorado, are similarly noted to lose their water-channeling properties due to dirt buildup. These commercial products state such, in literature to homeowners that advises them on the proper method of cleaning and maintaining their products.

With the exception of U.S. Pat. No. 6,598,352, none of these above-described systems keep all debris out of a gutter system allowing water alone to enter, for an extended length of time. Some allow lodging and embedding of pine needles and other debris to occur within their open water receiving areas causing them to channel water past a rain gutter. Others allow such debris to enter and clog a rain gutter's downspout opening. Still others, particularly those employing filter membranes, succumb to a paste and or scum-like healing over and clogging of their filtration membranes over time rendering them unable to channel water into a rain gutter. Pollen and silica dirt, particularly, are noted to cement even larger debris to the filter, screen, mesh, perforated opening, and/or reverse curved surfaces of prior art, adhering debris to prior art in a manner that was not envisioned. My earlier patent has proven effective but may exhibit undesirable cosmetic features and may prove difficult, even impossible, to install under certain cold weather conditions.

Accordingly, it is an object of the embodiments of the present invention to provide a gutter shield that employs the effective properties of my U.S. Pat. No. 6,598,352: a gutter shield device that employs a fine filtration combination that is not subject to gumming or healing over by pollen, silica dust, oils, and other very fine debris, a gutter shield device that provides a filtration configuration and encompassing body that eliminates any forward channeling of rain water, a gutter shield that will accept more water run-off into a five inch K-style rain gutter than such a gutter's downspout opening is able to drain before allowing the rain gutter to overflow (in instances where a single three-inch by five-inch downspout is installed to service 600 square feet of roofing surface).

[Another object of the embodiments of the present invention is to provide a gutter shield with the above noted properties that incorporates and makes integral within it's main rigid body the features and structure of the insertable flexible polymer support skeleton disclosed in my U.S. Pat. No. 6,598,352 thereby eliminating the most prominent expansion and contraction coefficients found to exist between a rigid main body utilizing an insertable flexible polymer filtration configuration.

Another object of the embodiments of the present invention is to provide a gutter shield with the above noted properties that utilizes a stainless steel or aluminum micromesh filter cloth that may be inserted into a main body with integral recessed and perforated wells that incorporate integral upward extending planes allowing for a lower cost of manufacture by eliminating a separately manufactured flexible polymer support skeleton and allowing for a lighter, more stable under varying temperatures, and more easily installed insertable filtering component.

Another object of the embodiments of the present invention, is to provide a gutter shield that employs a filtration membrane that is readily accessible and easily replaceable if such membrane is damaged by nature or accident.

Other objects will appear hereinafter.

SUMMARY

In one example embodiment, a gutter shield device for mounting to a rain gutter is provided. The gutter shield device comprises an elongated body comprising a first body portion; a second body portion; and an intermediate body portion disposed between the first and second body portions and connected to the first and second body portions. The intermediate body portion defines a surface and includes a plurality of extending portions extending in a direction away from the surface to define a plurality of openings in the surface. The gutter shield device further comprises a filter element secured to the intermediate body portion such that surface of the filter element is arranged adjacent to the openings.

In another example embodiment, the intermediate body portion is connected to the first and second body portions by a first u-shaped receiving channel and a second u-shaped receiving channel, respectively. The filter element includes a first lateral edge received in the first u-shaped receiving channel of the intermediate body portion and a second lateral edge received in the second receiving channel of the intermediate body portion.

In another example embodiment, the surface of the filter element arranged adjacent to the openings contacts the surface defined by the intermediate portion, whereby, when water is passed over the filter element, the water is directed away from the filter element, through the openings, and along the plurality of extending portions.

In yet another example embodiment, the filter element comprises a plurality of interwoven threads defining a mesh screen. The mesh screen may define a mesh of between approximately 80 and 280 and the plurality of interwoven threads defining the mesh screen may comprise a plurality of stainless steel or aluminum threads.

In still another example embodiment, a diameter of each of the plurality of interwoven threads is between approximately 0.04 mm (0.0015 in) and approximately 0.14 mm (0.0055 in).

In still another example embodiment, the mesh screen comprises a plurality of intersecting threads having a diameter, each intersection of threads being crimped or pressed so that a maximum thickness of the mesh screen is less than two times the thread diameter.

In another alternative example embodiment, a body of a gutter shield device for mounting to a rain gutter is provided. The body of the gutter shield device comprises a first body portion; a second body portion; and an intermediate body portion disposed between and connected to the first and second body portions. The intermediate body portion defines a surface adapted to receive a filter element thereon and includes a plurality of extending portions extending in a direction away from the surface to define a plurality of openings in the surface. When the filter element is secured to the surface of defined by the intermediate body portion, a surface of the filter element is positioned adjacent to the plurality of openings.

In another example embodiment, the intermediate body portion is connected to the first and second body portions via a first u-shaped receiving channel and a second u-shaped receiving channel, respectively. The first and second u-shaped receiving channels are adapted to hold lateral edges of the filter element therein.

In another alternative example embodiment, a filtration element adapted to be mounted to a rain gutter is provided. The filtration element comprises a plurality of interwoven threads defining a first substantially planar surface and at least one substantially planar extending portion extending at an angle to the first substantially planar surface. The at least one substantially planar extending portion may be a folded portion. The at least one extending portion may be a plurality of spaced extending portions defining a plurality of substantially planar surfaces extending at angles to the first substantially planar surface. Each of the plurality of extending portions may be a folded portion.

In yet another example embodiment, the plurality of interwoven threads may be metallic threads, for example, stainless steel or aluminum threads. The plurality of interwoven threads may define a mesh screen having a mesh of, for example, between approximately 80 and 280.

In still another example embodiment, a diameter of each of the plurality of interwoven threads is between approximately 0.0015 inches and 0.0055 inches.

In still another example embodiment, the mesh screen may comprise a plurality of intersecting threads having a diameter, each intersection of threads being crimped or pressed so that a maximum thickness of the mesh screen is less than two times the thread diameter.

DETAILED DESCRIPTION

Figure 6:
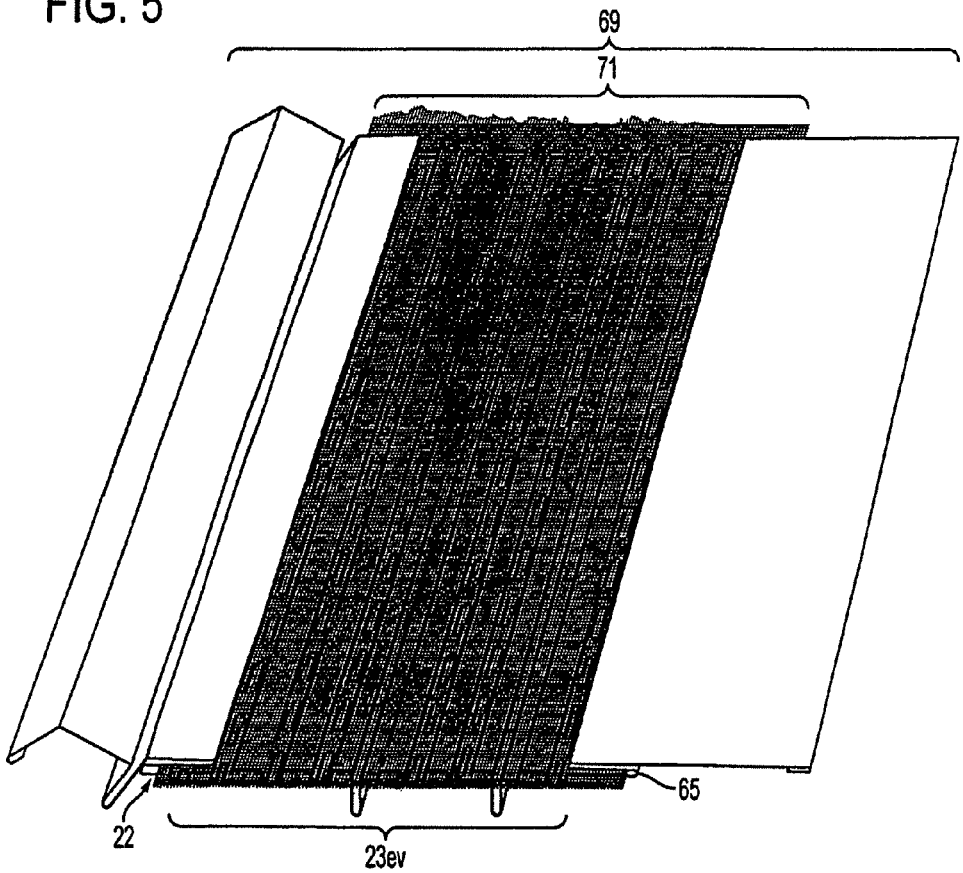
FIG. 6. is a partial top perspective view of an example embodiment of the present invention displaying the main body of the gutter cover assembled with inserted filter medium.

Referring now specifically to the drawings, FIG. 6 shows a gutter cover (protector) body 69 with an insertable metallic micro mesh filtering membrane 71 attached thereto.

In one embodiment, body 69 may be composed of poly vinyl chloride (PVC) that is reduced to liquid form through screw compression of PVC "tags". This liquid plastic mixture is then extruded through a profile forming die, then through a cooling tray and cut to 5 foot lengths. The extruded body material is rigid and has a thickness of approximately 0.06 inch. The extruded body 69 has intrinsic channels 22 and 65 arranged to receive, for example, an insertable stainless steel wire cloth 71 of 120 "thread count" with hemmed lateral edges and having a width of 3 and ⅝ inches. In another embodiment, body 69 may be a metallic body roll-formed from 0.019 to 0.027 aluminum coil and slit to widths of 11¾ inches and greater; depending on the width of gutter to be covered.

Figure 1:
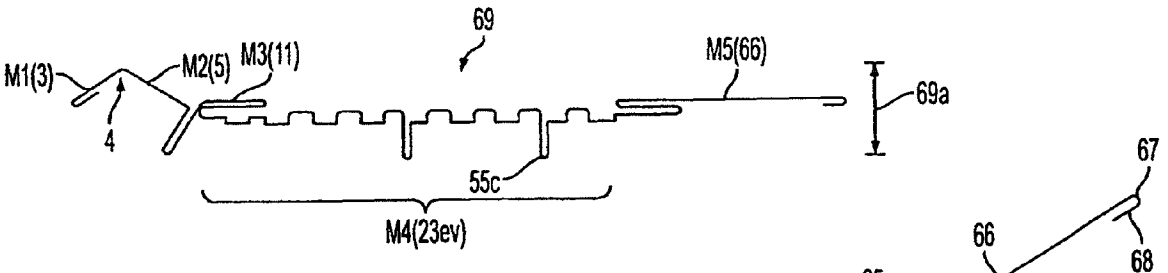
FIG. 1. is a sectional edge view displaying the profile of the main body of an example embodiment of the present invention as it would appear extruding from a roll forming machine or plastic extrusion die.

Referring to FIG. 1, a profile of the main body 69 of an example embodiment of the present invention is illustrated having five major interconnected planes, M1(3), M2(5), M3(11), M4(23*ev*), M5(66) with a width that may vary between 5.4 and 7 inches (illustrated at 5.4 inches wide) and a height 69*a*, measured from the lowest point of channel 55*c* to the uppermost point of angle 4, of approximately 0.67 inch.

Figure 2:
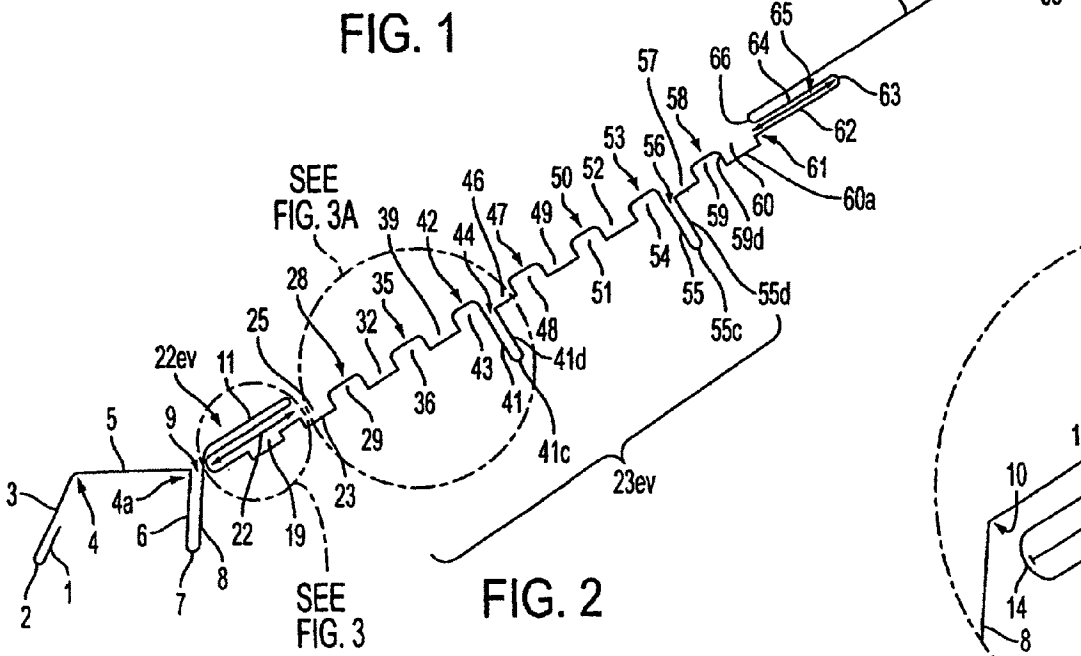
FIG. 2. is a detailed sectional edge view displaying the profile of the main body of FIG. 1.

Referring to the example embodiment depicted in FIG. 2, plane 1 is extruded or roll formed to a length of approximately 0.11 inch. Adjoining plane 1 is circumference 2 which is extruded or roll formed to an outside diameter of approximately 0.06 inch. Adjoining circumference 2 is plane 3 having a length of approximately 0.53 inch. Plane 3 adjoins and angles 4 approximately 60 degrees downward from horizontal plane 5. Plane 5 has an approximate length of 0.5 inch and extrudes or roll forms downward at an approximate 96 degree angle 4*a* to form downward extending plane or channel 9 which is formed by plane 6, circumference 7, and plane 8.

In its roll formed metallic state, portions 6, 7, and 8, form a downward extending u-shaped channel 9 with an open air space existing between planes 6 and 8 of approximately 0.022 inch. In its roll formed metallic state, plane 6 has a length of approximately 0.49 inch, plane 8 has a length of approximately 0.42 inch and circumference 7 has an outside diameter of approximately 0.06 inch. When the body 69 is formed as an extruded polymer product, channel 9 is non-existent and planes 6 and 8 are combined integrally and may be thought of as singular plane 6/8 with 7 existing as a termination of the downward extension of 9.

The combination of body portions 1, 2, 3, 4, 5, 6, 7, 8, 9 of the present invention in its roll formed metallic state, or the combination of body portions 1, 2, 3, 4, 5, 6/8, 7 of the present invention in its extruded polymer state, forms a front fastening member arranged to secure the body 69 to the top front lip of a k-style gutter, for example.

Figure 3:
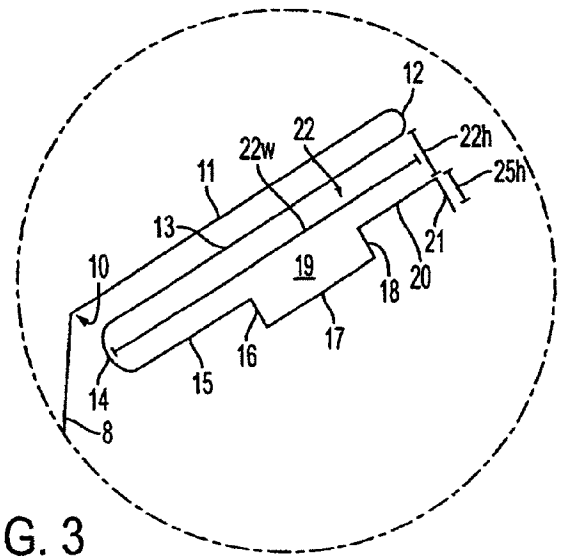
FIG. 3. is an isolated view of the profile of the main body of FIGS. 1 and 2.

Referring to FIG. 3, which is an exploded view of the embodiment depicted in FIG. 2:22*ev*, plane 11 adjoins and angles rearward (toward the rear of the present invention) and upward from plane 8 approximately 30 degrees forming an angle 10 between planes 8 and 11 of approximately 60 degrees. Plane 11 has an approximate length of 0.44 inch. Plane 11, in a roll formed metallic embodiment of the body 69 of the present invention, adjoins circumference 12 which curves downward into plane 13 that lies directly beneath and parallel to plane 11. In this roll formed metallic state, plane circumference 12 has an approximate outside diameter of 0.06 inch. and plane 13 has an approximate length of 0.44 inch. Alternatively, when the body 69 is formed as an extruded polymer product plane 11 and plane 13 combine integrally and may be thought of as singular plane 11/13 with 11 being the topmost surface and 13 the undersurface of 11/13 and circumference 12 exists as a termination point rather than as a circumference. Plane 13 is a separate plane in the metallic roll formed state of the present invention and adjoins downward curving circumference 14. Similarly, plane 11/13 is a singular plane in the extruded polymer state of the present invention and adjoins downward curving circumference 14.

Circumference 14 may have an outside diameter of approximately 0.075 and adjoins plane 15 which is parallel to plane 13 (or plane 11/13). Plane 15 has an approximate length of 0.17 inch. Plane 15 adjoins plane 16 which has an approximate length of 0.045 inch and angles downward approximately 90 degrees from plane 15. Plane 16 angles rightward and upward at an approximate 90 degree angle and adjoins plane 17. Plane 17 has an approximate length of 0.157 inch and adjoins upward angling plane 18 at an approximate 90 degrees. Plane 18 has an approximate length of 0.045 inch and adjoins plane 20 at an approximate 90 degree angle.

Plane 20 has an approximate length of 0.10 inch. Planes 16, 17, and 18 form a recessed well 19 shown to serve as a perforated water receiving well (see FIGS. 3 and 4).

Plane 11, circumference 12, plane 13 (or plane 11/13), circumference 14, planes 15, 16, 17, 18, and 20 form a u-shaped receiving channel 22 with an approximate width 22*w* of 0.48 inch and an approximate height 22*h* of 0.056 measured from planes 13 to 20. This receiving channel is illustrated and referred to, collectively, as 22 as illustrated in FIG. 6. FIG. 6 further illustrates that an example embodiment of the present invention may employs a second receiving channel 65 that serves, with channel 22, to receive and secure filtering membrane 71. The structure and dimensions of receiving channel 65 are discussed further below.

Figure 3A:
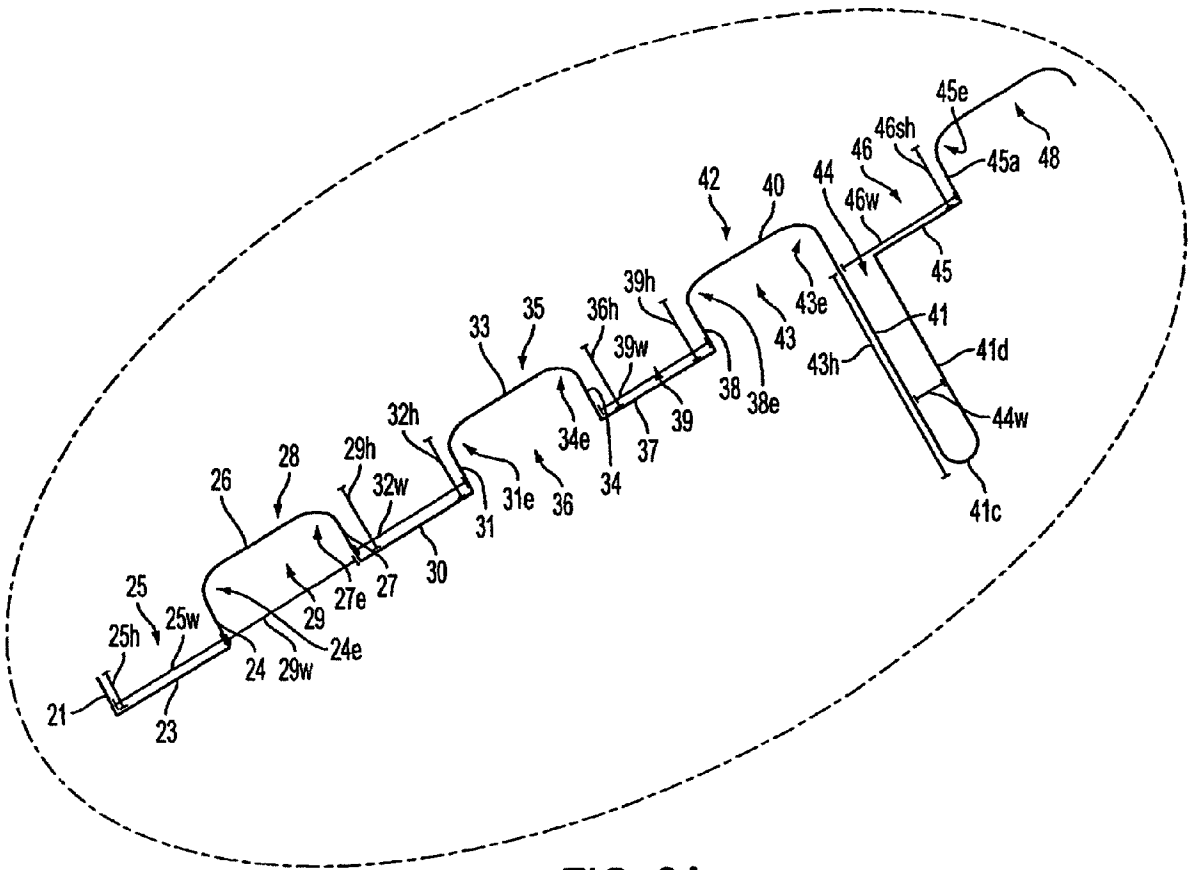
FIG. 3*a*. is an isolated view of the profile of the main body of FIGS. 1-3.
Figure 4:
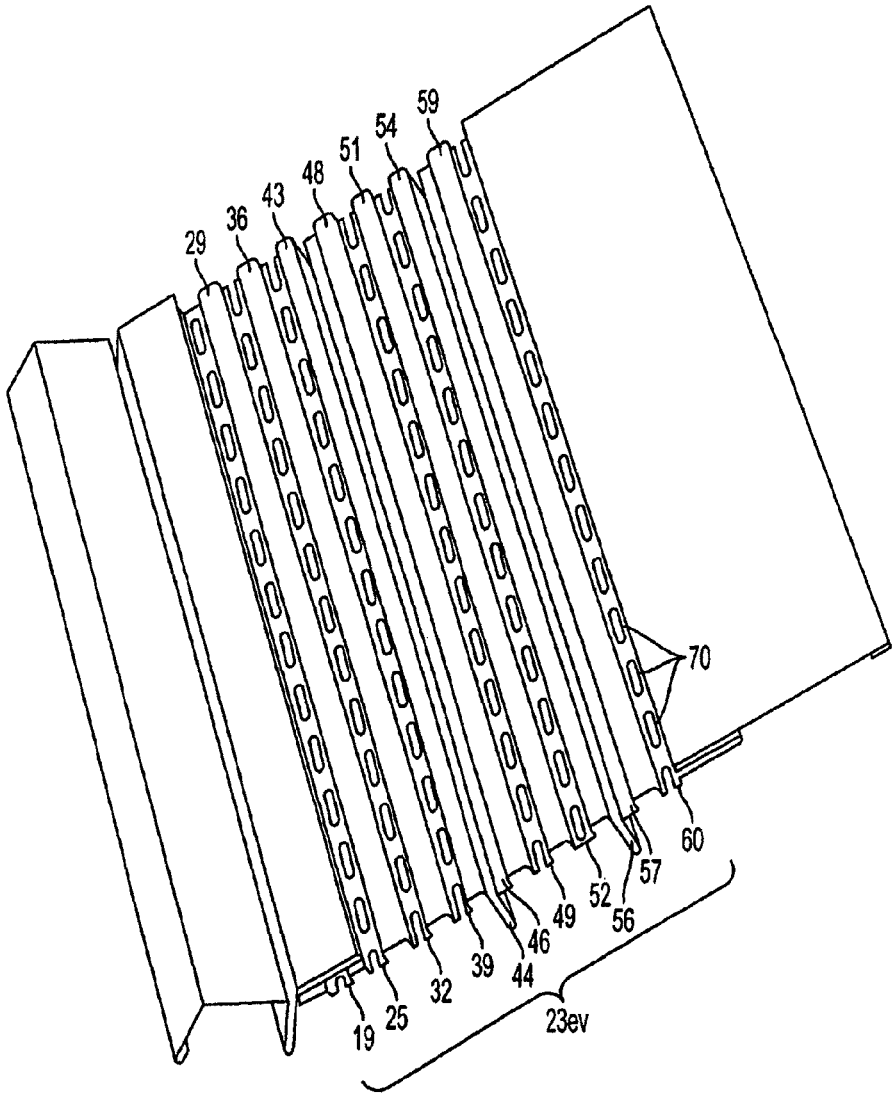
FIG. 4. is a partial top perspective view of the main body of FIG. 1.

FIG. 2 illustrates a multilevel water receiving area of an example embodiment of the present invention. Referring to FIG. 3*a*, which is an exploded view of portion 23*ev* of FIG. 2, plane 20 is formed or extruded at an approximate 90 degree downward angle into plane 21. Plane 21 may have an approximate length of 0.045 inch and is extruded or roll formed rearward into plane 23. Plane 23 is perforated, as is illustrated in FIG. 4, with elliptical perforations 70 which may be, for example, approximately 0.09 in wide, 0.38 inches long, and spaced longitudinally at approximately 0.15 inch intervals. As a profiled illustration, plane 23 may have an approximate length of 0.154 inch and is extruded or roll formed upward at an approximate 90 degree angle into plane 24. Plane 24 may be roll formed or extruded upward approximately 0.045 inch then further roll formed or extruded into partial ellipse 24*e*. Planes 21, 23, 24 jointly form a water receiving perforated well or channel 25 (further illustrated in FIG. 4) that may have an approximate height 25*h* of 0.06 inch and an approximate interior width 25*w* of 0.15 inch. measured from the inner wall of plane 21 to the inner wall of plane 24.

Partial ellipse 24*e* may have an approximate partial circumference of 0.03 inch. Partial ellipse 24*e* is roll formed or extruded into plane 26 which, if extended, parallels plane 23. Plane 26 may have an approximate length of 0.076 inch. and is roll formed or extruded downward into partial ellipse 27*e*. Partial ellipse 24*e*, plane 26, and plane 27*e* jointly form an ellipsed cap 28 that contacts the underside of an overlying filtration membrane 71 (as illustrated in FIG. 6). Ellipsed cap 28 may have an approximate length of 0.16 inch measured from the initial point of partial ellipse 24*e*, through plane 26, to the termination point of partial ellipse 27*e*. Partial ellipse 27*e* is roll formed or extruded downward into plane 27 which parallels plane 24. Plane 27 may have an approximate length of 0.045 inch.

Referring again to FIG. 3*a*, plane 24, partial ellipse 24*e*, plane 26, partial ellipse 27*e*, and plane 27 jointly form a "bump" 29 that extends upward and supports and contacts the underside of an overlying filtration membrane 71 (as illustrated in FIG. 6) that rests on the ellipsed cap 28 integral to bump 29. Bump 29 may have an approximate height 29*h* of 0.068 inch and an approximate width 29*w* of 0.13 inch.

Referring again to FIG. 2 and FIG. 3*a*, "Bumps" 36, 43, 48, 51, and 59 and their respective integral caps 35, 42, 47, 50, and 58 existent in the multi-level water receiving well of the present invention may have measurements identical to bump 29 and its respective integral cap 28 as illustrated in FIG. 3*a*.

Referring again to both FIG. 2 and FIG. 3*a*, "Bumps" 43 and 54 with their respective integral caps 42 and 53 also have measurements identical to bump 29 and its respective integral cap 28 with the exception of their rear most downward extending legs 41 and 55 respectively. These legs may each have an approximate length of 0.25 inch and serve to form a wall of downward extending channels 44 and 56 respectively as well as act as a supporting plane for the respective bumps they exist in.

Referring again to FIG. 3*a*, as previously described, partial ellipse 27*e* extends downward into plane 27 which further extends at a 90 degree angle into plane 30. As a profiled illustration, plane 30 may have an approximate length of 0.154 inch. Plane 30 is perforated, as is illustrated in FIG. 4 with elliptical perforations 70 that may be, for example, approximately 0.09 in wide, 0.38 inches long, and spaced longitudinally at approximately 0.15 inch intervals. Plane 30 extends upward at an approximate 90 degree right angle into plane 31. Plane 31 parallels plane 27 and may have an approximate length of 0.045 inch. Plane 31 extends upward into partially ellipsed plane 31*e*. Partially ellipsed plane 31*e* may have an approximate partial circumference of 0.03 inch. Partial ellipse 27*e*, plane 27, plane 30, plane 31, and partial ellipse 31*e* jointly form perforated well 32.

Wells 39, 49, and 52 existent in the multi-level water receiving well of the present invention have measurements identical to well 32 of the present invention. The dimensions of wells 22 and 24 have been previously described in this disclosure.

Referring again to FIG. 2:23*ev*, wells 46 and 57 incorporate two downward extending planes or channels 44 and 56 respectively which differentiates them from other perforated wells existent in the present invention. Wells 46 and 57 and their respective channels 44 and 56 may have identical measurements.

Well 46 is jointly formed by partial ellipse 43*e*, plane 41, circumference 41*c*, plane 41*d*, plane 45, plane 45*a* and partial ellipse 45*e*. Partial Ellipse 43*e* may have an approximate partial circumference of 0.03 inch and extends downward into plane 41 which parallels plane 38. Plane 41 may have an approximate length of 0.28 inch and extends into circumference 41*c*.

Circumference 41*c* may have an approximate outside diameter of 0.06 inch. Circumference 41*c* extends upward into plane 41*d*. Plane 41*d* may have an approximate length of 0.23 inch. Plane 41*d* extends into or joins plane 45 at an approximate 90 degree angle. Plane 45 may have an approximate length of 0.13 inch. Plane 45 extends upward into partial ellipse 45*e* which may have an approximate partial circumference of 0.03 inch. As mentioned earlier, well 57 may have measurements identical to those of well 4.

Plane 41, circumference 41*c*, and plane 41*d* within well 46 additionally jointly form channel 44 which may have an approximate height 43*h* of 0.24 inch and an approximate width 44*w* of 0.03 inch. As mentioned earlier, channel 56 within well 57 may have measurements identical to those of channel 44.

Referring again to FIG. 2:23*ev*, plane 59*d* may have an approximate length of 0.45 inch and extends into plane 60*a*. Plane 60*a* may have an approximate length of 0.154 inch and extends upward at an approximate 90 degree angle into plane 61. Plane 61 may have an approximate length of 0.045 inch. Plane 59*d*, plane 60*a* and plane 61 jointly form perforated well 60.

Referring again to FIG. 2, plane 61 extends at an approximate 90 degree angle into plane 62 which serves as the bottom shelf of receiving channel 65 and may have an approximate length of 0.44 inch. Plane 62 extends upward into partial circumference 63 which may have an approximate outside diameter of 0.05 inch. Partial circumference 63 extends into plane 64 which serves as the top shelf of receiving channel 65 and may have an approximate length of 0.4 inch. Plane 62, partial circumference 63, and plane 64 jointly form the second receiving channel 65 according to one embodiment of the present invention which is arranged to receive and secure a lateral edge of the filtration membrane 71 as illustrated in FIG. 6.

Plane 64 extends upward into partial circumference 66. Partial circumference 66 may have an approximate outside diameter of 0.05 inch and extends rearward into plane 66. Plane 66 may have an approximate length of 1.55 inch. Partial circumference 66 extends downward into partial circumference 67 which may have an approximate outside diameter of 0.06 inch. Partial circumference 67 extends into plane 68 which may have an approximate length of 0.11 inch.

Figure 5:
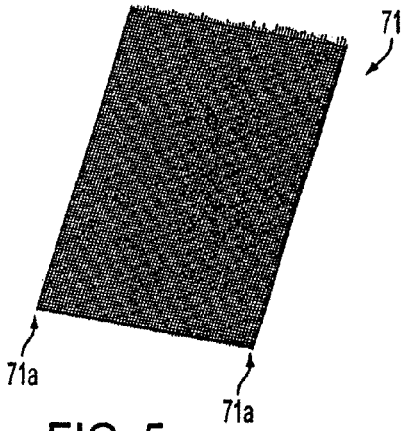
FIG. 5. is an isolated view of an example filter medium which may be affixed to the main body of FIGS. 1-4 or which is inserted into filter medium receiving channels of the main body of FIGS. 1-4.
Figure 5A:
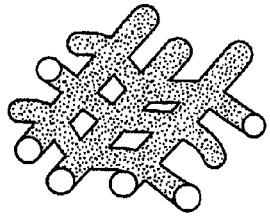
FIG. 5*a*. is an isolated and exploded view of the example embodiment of the filter medium of FIG. 5. is an isolated view of an example filter medium which may be affixed to the main body of FIGS. 1-4 or which is inserted into filter medium receiving channels of the main body of FIGS. 1-4.

Referring to FIGS. 5 and 5*a*, there is illustrated in 71*a* metallic filtering membrane composed of stainless steel threads. This filtering membrane is commonly referred to as "wire cloth" and is presently employed as a screening debris filter in the manufacture of plastics and as a filtering component of industrial mufflers. The diameter of the metallic threads may range from approximately 0.04 mm (0.0015 in) to approximately 0.14 mm (0.0055 in) and may be crimp woven in meshes from 280 to 80 mesh (thread counts or openings per inch), respectively.

Referring to FIG. 5 it is illustrated that the filtering cloth 71 has its lateral edges folded over or hemmed 71*a* to eliminate sharp cutting edges often noted in wire cloth.

Referring to FIG. 6 it is illustrated that filtering cloth 71 is inserted into the body 69 of the present invention and held in place by channels 22 and 65. In the field it has been noted that filtering cloth 71 will not be dislodged by wind due to the natural stiffness present in wire cloths of 120 mesh or less.

Referring to FIG. 6, there is illustrated an example embodiment of the present invention. A gutter protection system includes a main body 69 with integral filtration membrane receiving channels 22 and 65 enveloping the lateral edges of an insertable filtration membrane 71 that overlies a multi-level supporting skeleton of perforated planes, non perforated planes, upward extending nodes and downward extending planes collectively noted as 23*ev*.

The main body, 69, may be an extruded polymer (e.g., Leaffilter®) or a roll formed aluminum product (Flow Screen®). Where body 69 is an extruded polymer, it may be, for example, composed of poly vinyl chloride (PVC) that is reduced to liquid form through screw compression of PVC "tags". This liquid plastic mixture is then extruded through a profile forming die, then through a cooling tray and cut to 5 foot lengths. This length has proven ideal for installation by one individual in that its length is short enough to be readily handled and accessed while allowing for as few joints or seams as possible to exist between adjoining body members of the present invention when it is installed over the length of a rain gutter. The extruded material is rigid and may have a thickness of approximately 0.06 inch. The extruded material has proven, in the field, to be suitably thick to maintain its shape and not deform or dip under load bearing weight of snow and ice or deform when exposed to high ambient temperatures which have caused prior art of lesser thickness to deform vertically upwards and downwards allowing open-air gaps to form from one piece op prior art to the next when the rest abutted side by side. These gaps may allow debris entrance into a gutter.

Figure 7:
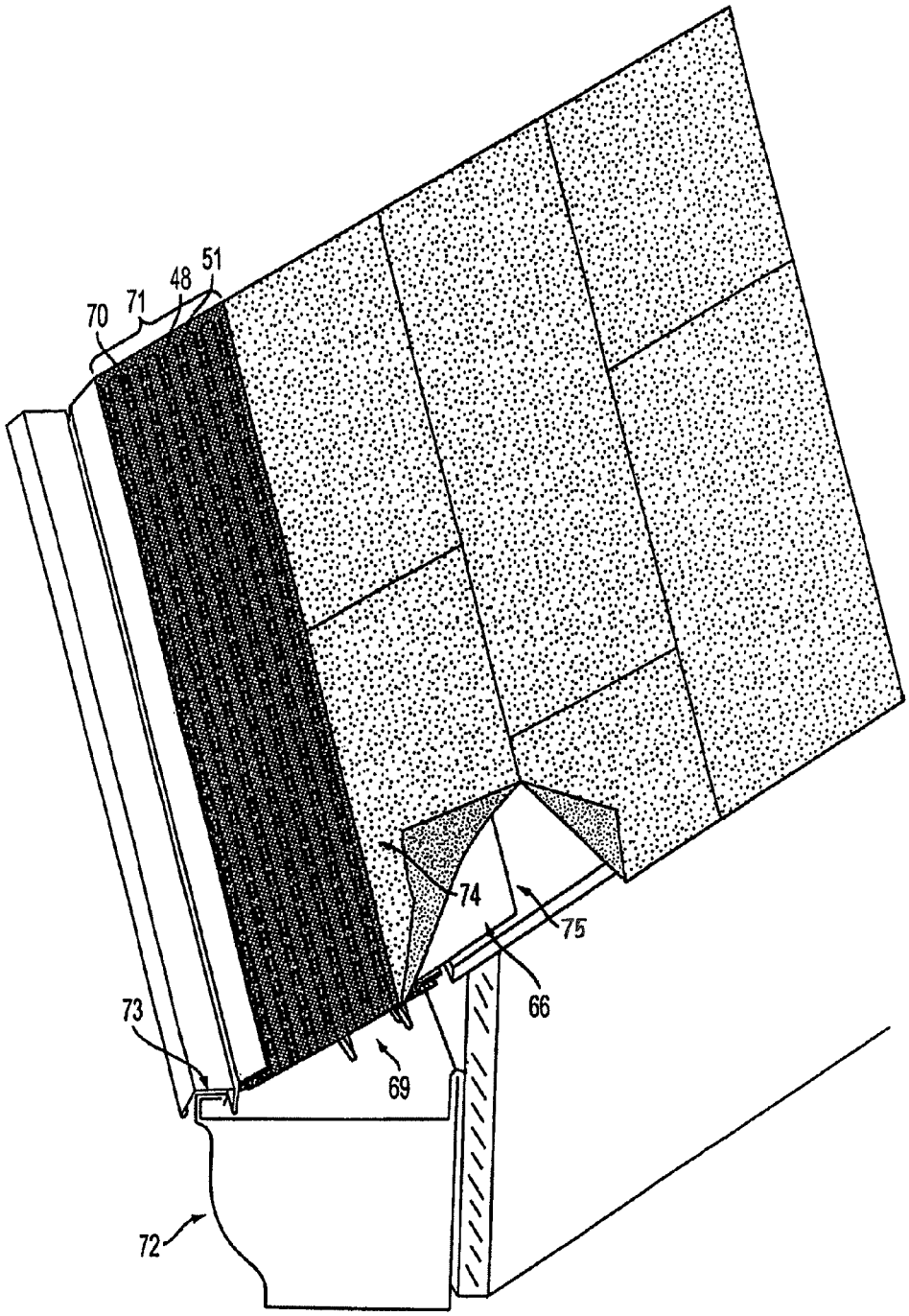
FIG. 7. is a partial top perspective view of an example embodiment of the present invention, displaying a roofline portion of a building structure, roof shingles, K-style gutter, and attached gutter cover.

Referring to FIG. 7, an example embodiment of the body 69 of the present invention is illustrated as inserted into the top water receiving opening of a k-style rain gutter 72 and resting on the front top lip 73 of the k-style rain gutter and resting on a sub-roof 75 of a building structure. The body 69 is secured to the underlying rain gutter 72 by the encompassing of the front top lip 73 of the rain gutter by planes 3, 5, and 6 and further secured by the insertion of plane 66 beneath roof shingles 74.

Once this is accomplished, main body 69 offers improvement over prior art as follows: As noted in U.S. Pat. No. 6,598,352: "Perforated surfaces existing in a single plane, such as are employed in U.S. Pat. No. 5,595,027 to Vail, or as exists in the Commercial Product SHEERFLOW® manufactured by L.B. Plastics of N.C., and similar prior art tend to channel water past perforations rather than down through them and into an underlying rain gutter. Prior art sought to correct this undesirable property by either tapering the rim of the open perforation and/or creating downward extensions of the perforation (creating a water channeling path down through open air space) as exhibited in prior art U.S. Pat. No. 6,151,837 to Ealer, or by creating dams on the plane the perforations exist on, as exhibited in prior art U.S. Pat. No. 4,727,689 to Bosler. Such prior art has been unable to ensure all water would channel into the underlying rain gutter because the water, that did indeed, travel through the open apertures on the top surfaces of these types of perforated planes or screens, would also travel along the underside of the screen wires or perforated planes, as it had on top of these surfaces, and still continue it's undesirable flow to the front of the invention and front lip of the underlying rain gutter, due to water adhesion. Additionally, this "underflow" of water on the underside of the perforated planes and screens illustrated in prior art exhibits a tendency to "backflow" or attempt to flow upwards through the perforations inhibiting downward flow of water. This phenomenon has been noted in practice, in the field when it has been observed that open air apertures appear filled with water while accomplishing no downward flow of water into the underlying rain gutter.

Other inventors sought to eliminate this undesirable property by employing linear rods with complete open air space existing between each rod, this method of channeling more of the water into the rain gutter exhibits greater success on the top surface of such inventions, but it fails to eliminate the "under channeling" of rainwater toward the front of the invention due to the propensity of water to follow the unbroken interconnected supporting rods or structure beneath the top layer of rods."

Figure 8:
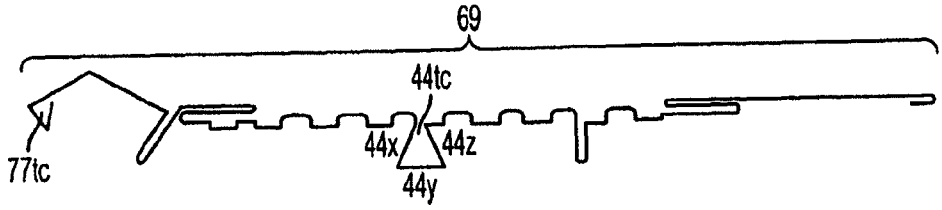
FIG. 8. is a sectional edge view displaying an alternate example embodiment of the profile of the main body of the present invention as it would appear extruding from a roll forming machine or plastic extrusion die.

I was able to accomplish significant improvement over prior art by employing a filter skeleton, illustrated in FIG. 3 of my U.S. Pat. No. 6,598,352, which incorporates ellipsed top members resting on upward extending planes adjoined to an underlying perforated planes. The upward extending planes of this filter skeleton contact the underside of a micromesh cloth composed of threads that are separated by no more than 120 microns of open airspace between threads and, at the point of plane and cloth contact, water has been noted to cease forward flow and redirect into significant downward flow of water into an underlying rain gutter. FIG. 8 of my U.S. Pat. No. 6,598,352 illustrates the filter skeleton and adjoined fine filtration cloth join and form separate member from the main body of the invention that is inserted into the main body of the invention. This unique configuration of fine filtration cloth and filter skeleton inserted into a recessed perforated well has been observed in practice, in the field over a two year period, to completely disallow the clogging of a rain gutter and to allow known clogging or moss overgrowth of the fine filtration cloth and skeleton combination in fewer than 10 product installations out of thousands of known installations. U.S. Pat. No. 6,598,352 has been marketed as "Leaffilter®".

During this period of practice in the field several improvements were made to U.S. Pat. No. 6,598,352 to ease its installation and lower its cost of manufacture and shipping. Most notably, in June of 2003, I redesigned the main body of the embodiment described in U.S. Pat. No. 6,598,352 to incorporate the upward extending planes found in it's insertable filter skeleton directly into the perforated recessed well of the main body. This has been accomplished in both an extruded polymer main body and in a roll formed aluminum body of the present invention: This significantly improves ease of installation in that the present embodiment of "Leaffilter®" no longer employs an insertable polymer filter skeleton that was extruded in 50 foot lengths rolled into rolls approximately two feet in diameter and weighing approximately 9 lbs. These were discovered to be difficult to install due to the size and weight of the insertable filtration member and noted to significantly stiffen as field temperatures cool below approximately 40 degrees. Additionally, the insertable polymer filter skeleton illustrated in FIG. 6 of my U.S. Pat. No. 6,598,352 required transportation to a sewing converter which accomplished unrolling and re-rolling of the polymer filtration skeleton as polymer filtration cloth was sewn to the base of the skeleton. This action required additional shipping costs as well.

Referring to FIG. 3, there is illustrated a multi level supporting skeleton comprised of perforated plane 17 (existing beneath plane 11), non perforated planes 18, 20, 21, and, referring to FIG. 4, comprised of perforated planes 25, 32, 39, 49, 52, 60, and comprised of non perforated planes 46 and 57, and comprised of upward extending "bumps" 29, 36, 43, 48, 51, 54, 59, and comprised of non perforated planes 39 and 49 which are adjoined by downward extending channels 38 and 48 collectively. This multi-level support skeleton is referred to, collectively, as 23*ev*. Incorporating the upward extending planes and perforated wells found in the flexible insertable filter skeleton of my prior art into the main body of the present invention, in the above described manner, achieves the same water directing properties by means of water adhesion and water pressure (due to water volume existent in said wells) found in my prior art and does so utilizing less material resulting in a lower cost of manufacture while additionally eliminating a separate insertable member subject to stiffening during cold weather installations.

It was also discovered during this period of practice (installing the Leaffilter® gutter cover in the field over a period of two years) that the warp-knit polymer fabric employed as a filtration membrane sewn to an underlying insertable filtration skeleton, illustrated in FIGS. 5 and 6 of my U.S. Pat. No. 6,598,352, succumbed to UV exposure deterioration over a period of time regardless of the amount of UV inhibitors employed. This may have been due to the small denier of polymer threads that constituted the polymer fabric. Significant improvement is accomplished in the present invention in substituting a woven stainless steel micro mesh cloth as is illustrated in FIG. 6 of the present invention. In the prior art of U.S. Pat. No. 6,598,352 it is disclosed that threads that adjoin or intersect one another are less subject to debris lodging between threads and tend to present less resistance to downward water flow than does woven or knitted micromesh cloths: both intersecting threads of dissimilar deniers and adjoining threads of similar deniers have been noted to exhibit desirable debris repellant and water permeability features to a greater degree than is found in typical woven or knitted micromesh fabric. However, there is presently no known technology able to mass produce warp-knit cloth utilizing metallic threads. It has been noted in field installations of example embodiments of the present invention that woven stainless steel threads exhibit water permeability that approaches that found in polymer warp-knit micro mesh fabric, provided that the wire diameter of the woven stainless steel threads is between approximately 0.04 mm (0.0015 in) and approximately 0.14 mm (0.0055 in) and the micro mesh fabric has a mesh of between approximately 280.times.280 and approximately 80.times.80, respectively. For example, micro mesh fabric having a mesh of 100.times.100 may have a thread diameter of approximately 0.114 mm (0.0045 in). The wires (threads) may be crimped or pressed at their point of weave or contact so that the combined height of two threads is lessened at the point that one thread weaves over or under another. In testing, it has been further discovered that the same debris shedding properties are present in configurations of wire cloth that employ "crimped weaves" whereby pressure is applied at the point of weave contact between threads. This crimping of metallic threads at their point of contact places threads in more of a linear plane in relation to one another which allows the cloth to shed rather than trap debris. As disclosed in U.S. Pat. No. 6,598,352, the greater the vertical height between threads at their point of contact, the more likely it is that debris will be trapped and held rather than shed.

In one example embodiment of the present invention, woven wire cloth is utilized exclusively as it has been discovered that such cloth, even as a woven cloth, exhibits less shifting of threads and less height differential between threads as well as providing a filtering membrane less susceptible to decay in comparison to polymer or natural "warp-knit" fabrics.

FIGS. 5 and 5*a* illustrate an example stainless steel wire cloth 71 of not less than 100.times.100 mesh, crimp woven.

Referring now to FIG. 6, the illustrated micro mesh stainless steel wire cloth serves as an insertable filtration membrane 71 not subject to stiffening as field temperatures cool and has been noted, in the field, to be more easily handled in any temperature as it is much lighter and far less bulky than the filtration skeleton covered with attached polymer micromesh cloth that served as the insertable filtration member found in my prior art illustrated in FIGS. 5 and 6 of my U.S. Pat. No. 6,598,352.

In FIG. 5, reference numeral 71 illustrates that the lateral edges 71*a* of the stainless steel filtration membrane are hemmed. This is presently accomplished by passing 120 foot lengths of stainless steel cloth, slit to 4 inches width, through a roll former that hems the lateral edges of the stainless steel cloth and re-rolls its entire length into an easily handled roll approximately 4 inches in diameter and weighing less than 1.5 lbs. The manufacture and packaging of the stainless steel filtration member eliminates a shipping step necessary in manufacturing and packaging the polymer filtration skeleton used in other prior embodiments and allows the filtration member of example embodiments of the present invention to be packaged in the same box that holds 5 foot lengths of the main body. In contrast, the polymer filtration skeleton disclosed in prior embodiments, for example, the Leaffilter® product, was boxed separately from the main body of the Leaffilter® product. Hemming the stainless steel filtration membrane 71 provides a dull edge unlikely to cause cuts as filtration member 71 is handled in the field prior to and during installation.

The main body 69 is installed into the top open area of a k-style rain gutter 72 as illustrated in FIG. 7. Referring now to FIG. 6, installation of the stainless steel filtration member 71 is accomplished by grasping the leading edge of a roll of the filtration member and pulling it through channels 22 and 65 of the main body 69 of the present invention. Alternatively, filtration member 71 may be attached by any other known means such as, for example, welding, adhesive, or any other known fastener devices, to body 69. Referring again to FIG. 7, once this final step of installation is accomplished, rain water will flow off roof member 74 through stainless steel micro mesh filtration member 71 contacting upraised "bumps", such as 48 and 51, and being diverted downward by these planes down through perforations 70 into an underlying rain gutter 72. The present invention thereby provides a more economical and more readily installed gutter protection method than Leaffilter® offers while proving equally capable of preventing debris as small as 100 microns from entering a rain gutter while ensuring nearly 100% of rain water run off from roof members enters underlying gutters as has been noted in the field.

The dimensions listed in the foregoing Description are descriptive of the example embodiment of the present invention as it currently has been manufactured for 11 months in a polymer embodiment that is different in several respects (disclosed in this application) from its original manufactured embodiment that closely resembled the preferred embodiment illustrated in my U.S. Pat. No. 6,598,352. Additionally, a roll-formed metallic prototype of the present invention employing smaller thinner "bumps" and shallower perforated "wells" has demonstrated that the operation of the present invention; specifically its ability to break the forward flow of water that occurs over flat perforated planes and direct it downward, varies little providing that the height of "bumps" does not fall below 0.06 inch. and provided the dimensions of perforations 70 have a minimum length of 0.25 inch and a minimum width of 0.15 inch and are spaced longitudinally at a distance no greater than 0.18 inch. Smaller perforations spaced further apart proved insufficient at draining large amounts of water into an underlying rain gutter.

In summary, a critical element described in claim one of technology described in my U.S. Pat. No. 6,598,352 (under which the Leaffilter® is manufactured) is the utilization of upraised planes rising from and forming the sides of perforated wells. These underlying planes contact the underside of a filtration cloth and break the forward flow of water and direct it downward into an underlying rain gutter. This technology of "upraised planes" breaking the forward flow of water and directing it downward, described in my U.S. Pat. No. 6,598,352, has been demonstrated to remain effective through subsequent alternate embodiments described in this present invention that have unified separate elements and varied the height and the width and positioning of the upraised planes resulting in a more easily installed and economically manufactured product. The process of roll-forming metal disallows exact duplication of shapes and dimensions possible in extrusion of polymers. Extensive testing and redesign of an alternate metallic roll formed embodiment of the Leaffilter® product has disclosed that some further alterations of the dimension and position of water directing planes can be accomplished resulting in a more easily installed and economically manufactured product.

DESCRIPTION OF ALTERNATE EMBODIMENTS

Figure 9:
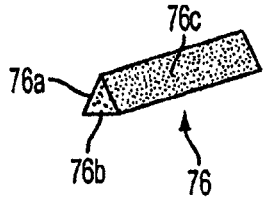
FIG. 9. is a partial top perspective view of an optional joining member that may be inserted into an alternate example embodiment of the main body of the present invention.
Figure 10:
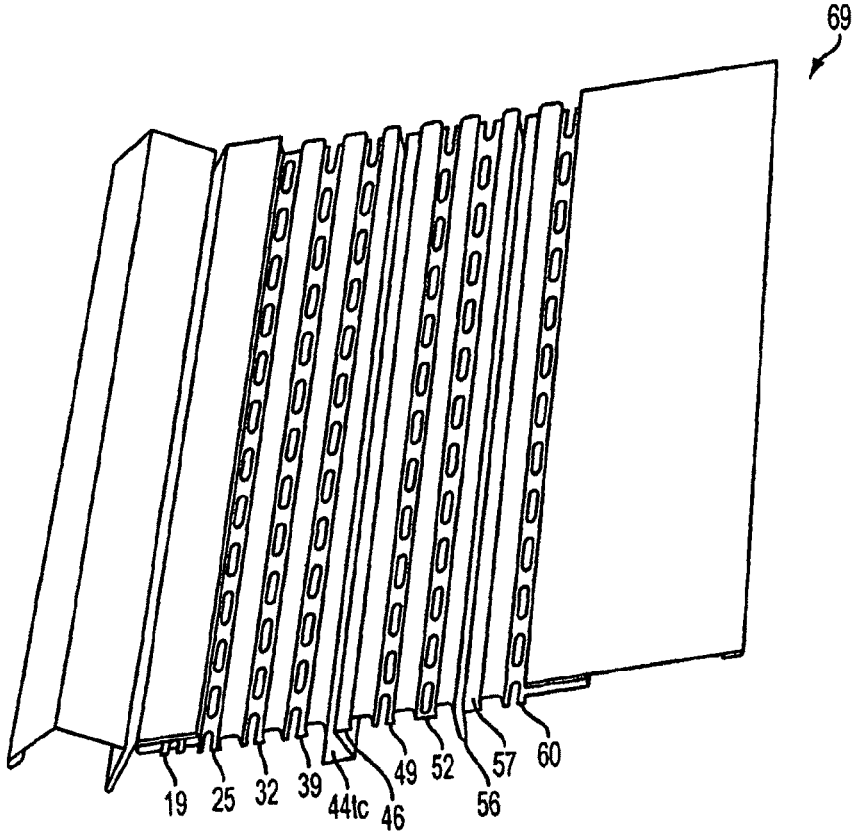
FIG. 10. is a partial top perspective view of an alternate example embodiment of the main body of the present invention.

Referring to FIG. 8 there is illustrated an alternate embodiment of the present invention. A triangular shaped channel 44*tc* is arranged to receive a triangular shaped joining member FIG. 76 (see FIG. 9). Sides 44*x* and 44*z* may have approximate lengths of 0.23 inch. and side 44*y* may have an approximate length of 0.28 inch. Triangular shaped joining member 76 may have equilateral sides with approximate lengths 76*a*, 76*b*, 76*b*, of 0.21 inch.

Figure 11:
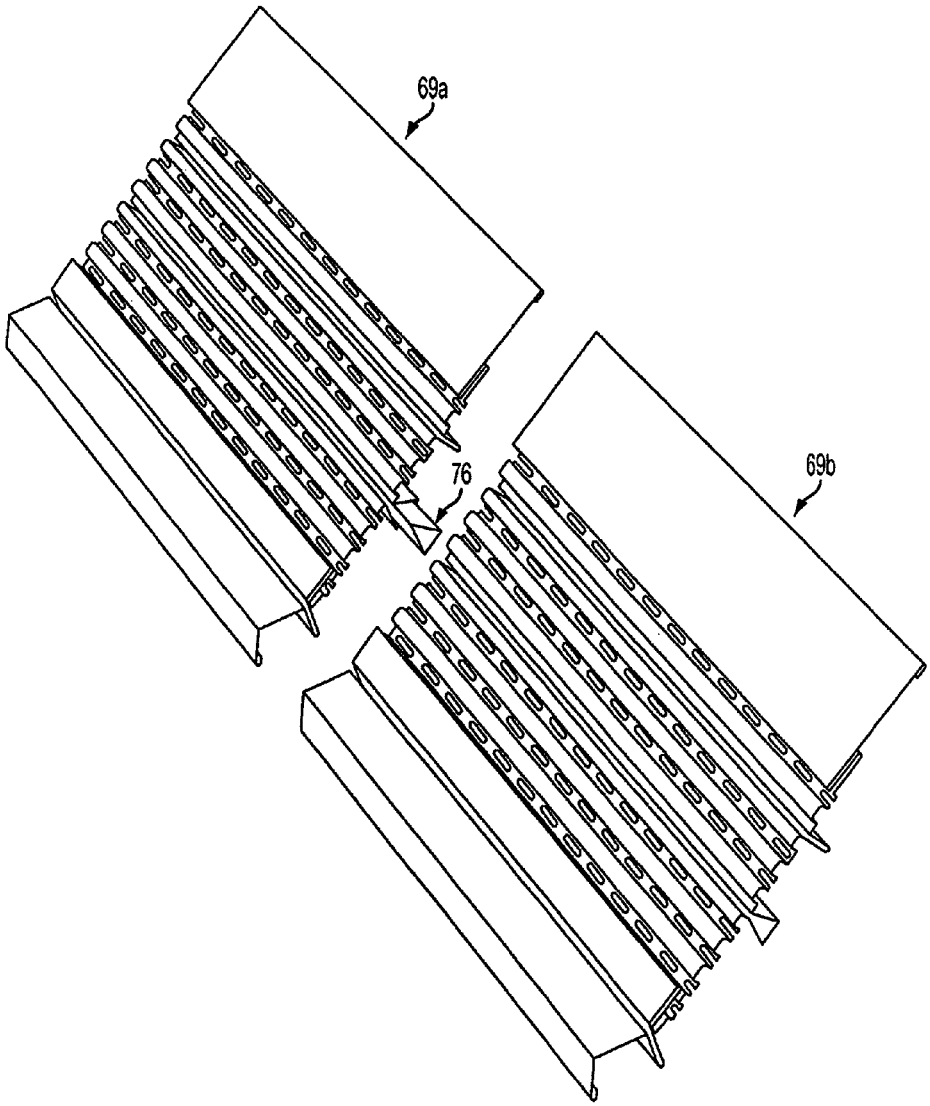
FIG. 11. is a partial top perspective view displaying a joining member inserted into an alternate example embodiment of the main body of the present invention prior to being joined to a second section of gutter cover.

It has been noted in the field that after installation of the body 69 into a rain gutter, a variance in height between adjoining main bodies 69 of the present invention may occur. This alternate embodiment serves to lock main bodies 69 into the same horizontal plane preventing any debris entrance into a rain gutter occurring through open air spaces that may occur if adjoining main bodies 69 rise or fall above or beneath one another. FIG. 11 further illustrates that joining member 76 inserts partially into the triangular shaped channel 44*tc* of a main body 69*a* allowing an adjoining main body 69*b* to be slid into place allowing its triangular shaped channel to encompass a remaining portion of joining member 76.

Referring again to FIG. 8, a triangular channel 77*tc* may also be employed at the front most portion of the main body 69 of the present invention to serve as a means of receiving joining members.

Referring to FIG. 8, downward extending triangular shaped channel 44*tc* is defined by walls 44*x*, 44*y*, 44*z*. This alteration of the downward extending channel illustrated in FIG. 2 allows for the insertion of an extruded polymer or roll formed metallic triangular shaped joining member 76 (see FIG. 9) to be inserted into two adjoining main bodies 69*a* and 69*b* of the present invention, as illustrated in FIG. 11, allowing the main bodies 69*a*, 69*b* to abutted against each other and held at a consistent level prohibiting one main body 69*a*, 69*b* from rising above or falling beneath the profile of previous or subsequent main body members 69*a*, 69*b* it may be abutted against.

Figure 12:
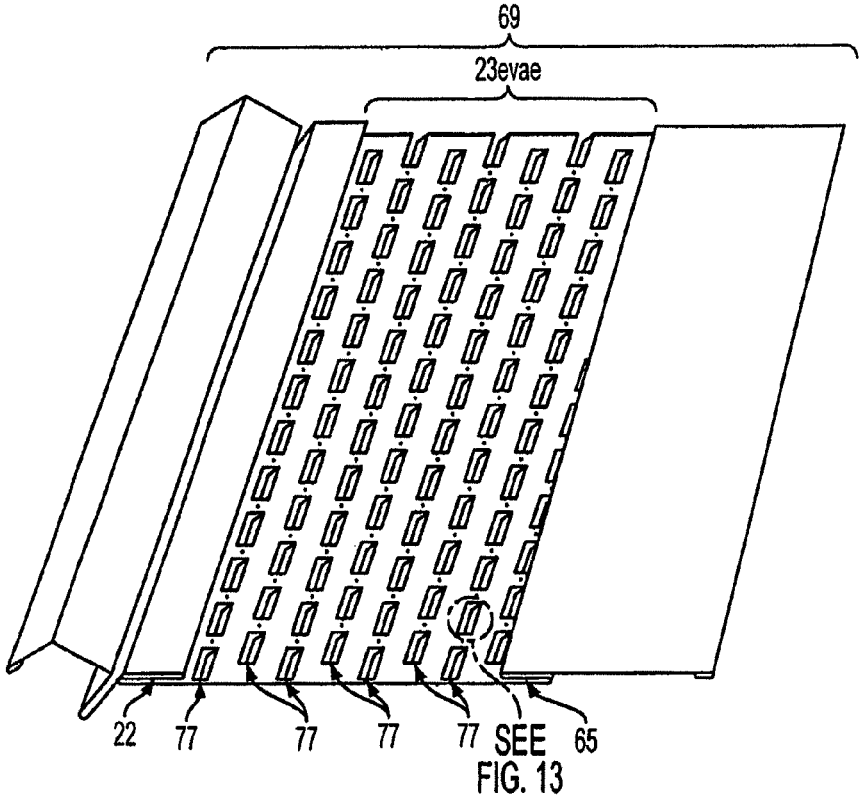
FIG. 12. is a partial top perspective view of an example alternative embodiment of the body of the present invention.
Figure 13:
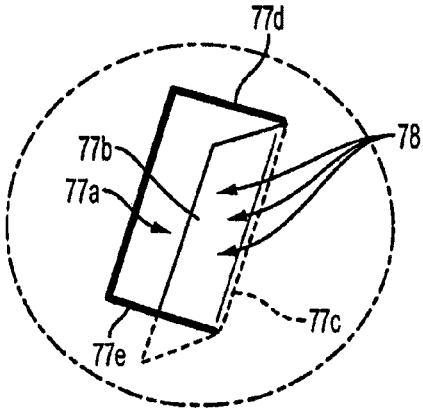
FIG. 13. is a detailed view of an opening in the intermediate body portion of the body according to the example embodiment of FIG. 12.

FIG. 12. is a partial top perspective view of an example alternative embodiment of the body of the present invention. The main body 69 includes an intermediate body portion (water receiving plane) 23*evae* having two channels 22 and 65 arranged to receive lateral edges of filtering screens or membranes 71 (see FIG. 14). Intermediate body portion 23*evae* defines a substantially planar surface and includes a plurality of downwardly extending portions 77*b* extending at an angle to the surface to define a plurality of openings 77 therein that serve to channel water downward and away from the surface. Referring to FIG. 13, there is illustrated a path of forward flowing water 78 that approaches an opening 77*a* and breaks downward at a topmost lateral edge 77*c* of downwardly extending planar portion 77*b* that extends between parallel edges 77*d* and 77*e* of opening 77*a*.

Figure 14:
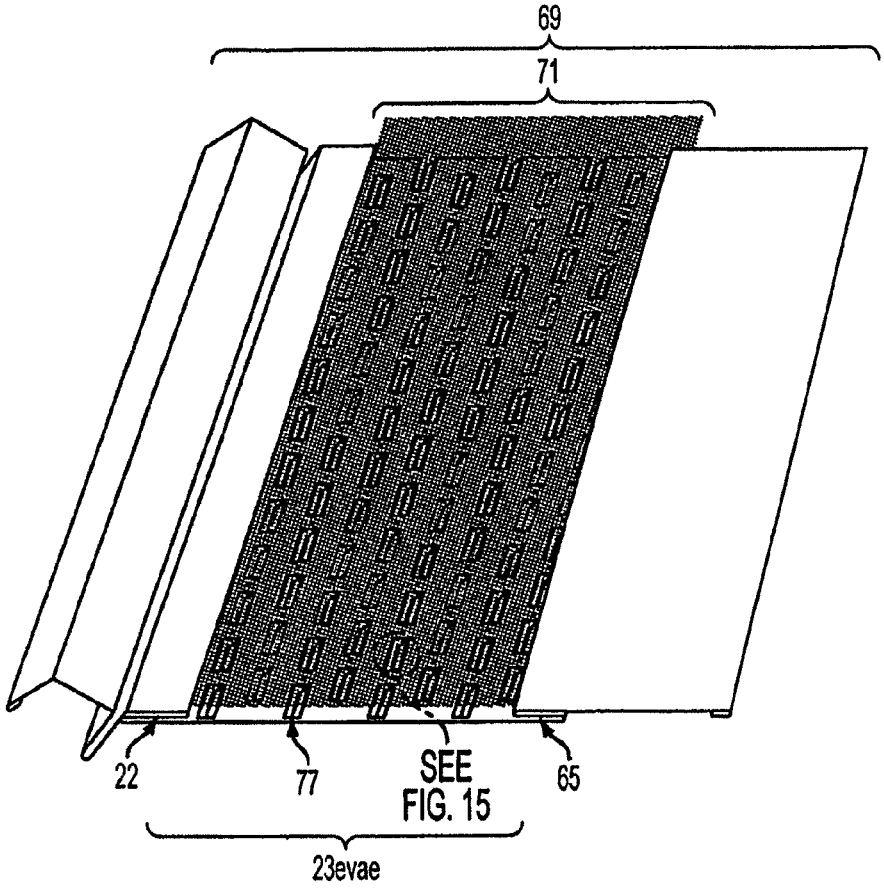
FIG. 14. is a partial top perspective view of a filtration element assembled with the body of FIG. 12 according to an alternative example embodiment of the invention.

FIG. 14. is a partial top perspective view of a filtration element 71 assembled with the body of FIG. 12 according to an alternative example embodiment of the invention. In the example embodiment depicted in FIG. 14, the filtration element 71 is shown as being inserted into receiving channels 22 and 65 and overlying the substantially planar surface defined by intermediate body portion 23*evae* and the plurality of openings 77 formed therein. Alternatively, filtration element 71 may be secured to the main body 69 by other known fastening techniques, for example, by welding, adhesive, and/or other known fastening devices.

Figure 15:
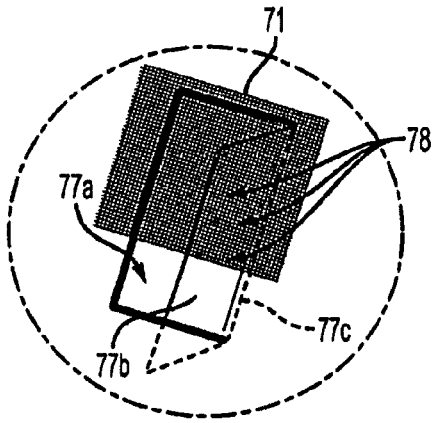
FIG. 15. is a detailed view of an opening covered by the filtration element according to the example embodiment of FIG. 14.

FIG. 15. is a detailed view of an opening 77*a* covered by the filtration element 71. Referring to FIG. 15, there is illustrated a path of forward flowing water 78 that flows, by water adhesion, along and around the threads of filtration element 71 toward opening 77*a*. Referring again to FIG. 14, filtration element 71 is contacted continuously on an underside thereof by the solid (e.g., non-punched) portions of the substantially planar surface defined by intermediate body portion 23*evae*. When and where such contact occurs, water will continue to flow forward. Referring again to FIG. 15, filtration element 71 is contacted on the underside thereof by the topmost lateral edge 77*c* of downward extending portion 77*b*. At these specific points of contact, water is channeled downward from filtration element 71, i.e., away from the substantially planar surface defined by the intermediate body portion 23*evae*, thereby breaking the forward flow of the water.

Figure 16:
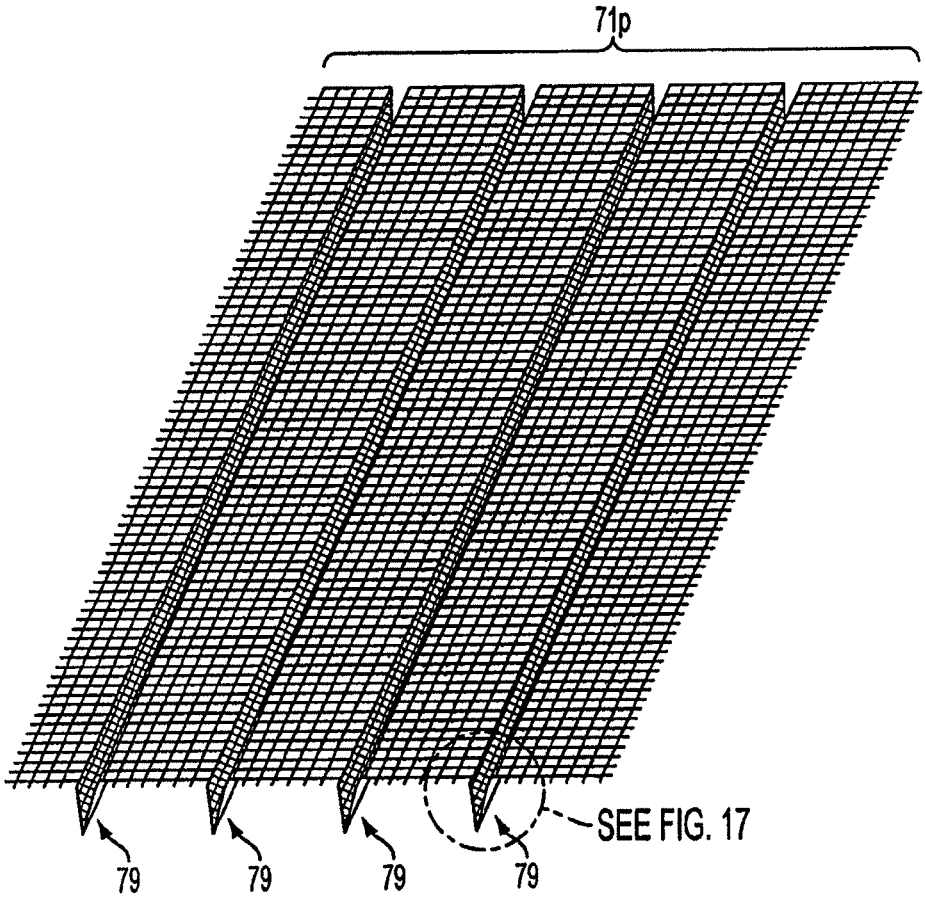
FIG. 16. is a partial top perspective view of a filtration element according to an alternative example embodiment.
Figure 17:
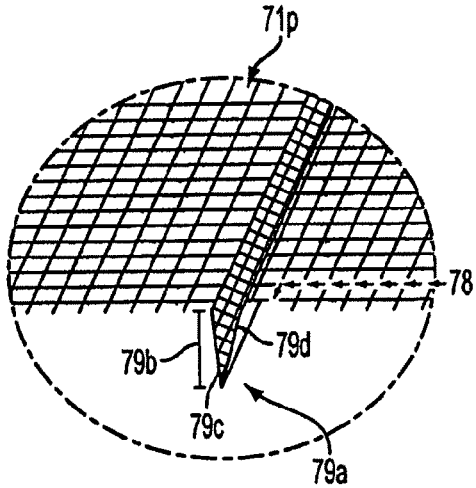
FIG. 17. is a detailed view of the filtration element according to the example embodiment of FIG. 16.

FIG. 16. is a partial top perspective view of a filtration element 71*p* according to an alternative example embodiment. Referring to FIG. 16, there is illustrated a filtration element 71*p* which defines a first substantially planar surface and which includes at least one substantially planar downward extending portion 79 extending at an angle to the first substantially planar surface. In the example embodiment, the downward extending portions 79 are folded portions of a continuous filtration element 71*p*. Referring to FIG. 17, the downward extending portion 79*a* is shown to have a predetermined length 79*b*. Where the downward extending portion 79*a* is a folded portion, such folded portion may be created by sewing, by compression, or by any effective means of holding sides 79*c* and 79*d* in close proximity to each other and at an angle with respect to the first substantially planar surface defined by filtration element 71*p*. Water 78 that adheres to and flows on and through element 71*p* is redirected into a downward flowing path at the downwardly portion 79*a*.

REFERENCE NUMERALS IN DRAWING

1. plane 1, length: approximately 0.11 inch
2. circumference 2, outside diameter approximately 0.06 inch
3. plane 3, length approximately 0.53 inch.
4. angle 4, approximately 60 degrees.
5. plane 5, length approximately 0.5 inch.
6. plane 6, length approximately 0.35 inch
7. circumference 7, when the present invention is in a metallic roll formed state, outside diameter approximately 0.06 inch termination point 7, when the present invention is in a polymer extruded state
8. plane 8, length approximately 0.42 inch
9. channel 9, when the present invention is in a metallic roll formed state, with an open air space of approximately 0.022 inch
10. angle 10, approximately 60 degrees
11. plane 11, length approximately 0.44 inch
12. circumference 12, when the present invention is in a metallic roll formed state, outside diameter approximately 0.06 inch termination point 12, when the present invention is in a polymer state
13. Plane 13, has an approximate length of 0.44 inch
14. circumference 14, has an approximate outside diameter of 0.075 inch
15. plane 15, length approximately 0.17 inch
16. plane 16, length approximately 0.045 inch
17. plane 17, length approximately 0.157 inch
18. plane 18, length approximately 0.045 inch
19. perforated well
20. plane 20, length approximately 0.10 inch
21. plane 21, length approximately 0.045 inch
22. receiving channel 22
22*w*. width: 0.48 inch of channel 22
22*h*. height: 0.056 inch of channel 22
23. plane 23, length of approximately 0.154 inch
23*ev*. multi-level water receiving area of the present invention
24. plane 24, length of approximately 0.045 inch
24*e*. partial ellipse, with a partial circumference of approximately 0.03 inch
25. perforated well
25*w* interior width: of perforated well 25: 0.15 inch measured from plane 21 to plane 24
25*h*. interior height: 0.06 of perforated well 25
26. plane 26, length approximately 0.070 inch measured from partial ellipse 24*e* to partial ellipse
27. plane 27, length approximately 0.045 inch
28. ellipsed cap 28, length approximately 0.16 inch
29. bump, a supportive and water directing plane
29*w*. interior width: 0.13 inch of bump 29 measured from plane 24 to plane 27
29*h*. height: 0.068 inch of bump 29
30. plane 30, length approximately 0.154 inch
31. plane 31, length approximately 0.045 inch
31*e* partial ellipse, with a partial circumference of approximately 0.03 inch
32. perforated well
32*w*. interior width: of perforated well 32: 0.15 inch measured from plane 27 to plane 31
32*h*. interior height: 0.06 inch of perforated well 32
33. plane 33, length approximately 0.070 measured from partial ellipse 31*e* to partial ellipse 34*e*
34. plane 34, length approximately 0.045 inch
34*e*. partial ellipse, with a partial circumference of approximately 0.03 inch
35. ellipsed cap 35, length approximately 0.16 inch
36. bump, a supportive and water directing plane
36*h* height: 0.068 inch of bump 36
37. plane 37, length approximately 0.154 inch
38. plane 38, length approximately 0.045 inch
39. perforated well
39*h*. interior height: 0.06 inch of perforated well 39
39*w*. interior width: of perforated well 39: 0.15 inch measured from plane 34 to plane 38
40. plane 40, length approximately 0.070 measured from partial ellipse 38*e* to partial ellipse 41*e*
41. plane 41, length approximately 0.28 inch
41*c*. circumference 41*c*, approximate outside diameter 0.06 inch
41*d*. plane 41*d*, length approximately 0.23 inch
42. ellipsed cap 42, length approximately 0.16 inch
43. bump, a supportive and water directing plane
43*h*. height: 0.33 inch of channel 44
44. channel 44
44*w* width: 0.03 inch of channel 44
44*tc*. alternate triangular shaped embodiment of channel 44
44*x*. side 44*x* approximate length 0.23 inch
44*y*. side 44*y* approximate length 0.28 inch
44*z*. side 44*z* approximate length 0.23 inch
45. plane 45, length approximately 0.13 inch
46. non-perforated well
46*h*. interior height: 0.06 inch of non-perforated well 46
46*w*. interior width: of on-perforated well 46: 0.15 inch measured from plane 41 to bump
47. ellipsed cap 47, length approximately 0.16 inch
48. bump, a supportive and water directing plane
49. perforated well
50. ellipsed cap 50, length approximately 0.16 inch
51. bump, a supportive and water directing plane
52. perforated well
53. ellipsed cap 53, length approximately 0.16 inch
54. bump, a supportive and water directing plane
55. plane 55, length approximately 0.28 inch
55*c*. circumference 55, approximate outside diameter 0.06 inch
55. plane 55*d*, length approximately 0.23 inch
56. channel 56
57. non-perforated well
58. ellipsed cap 58, length approximately 0.16 inch
59. bump, a supportive and water directing plane
60. perforated well
61. plane 61, length approximately 0.045 inch
62. plane 62, length approximately 0.44 inch
63. circumference 63, approximate outside diameter 0.06 inch
64. plane 64, length approximately 0.4 inch
65. channel 65
66. plane 66, length approximately 1.5 inch
67. circumference 63, approximate outside diameter 0.06 inch
68. plane 68, length approximately 1.5 inch
69. main body
70. perforations
71. metallic cloth filtration membrane
72. k-style rain gutter
73. top lip of k-style rain gutter
74. roof membrane
75. sub roof
76. joining member
76*a*. side 76*a* approximate length 0.21 inch

76*b*. side 76*b* approximate length 0.21 inch

76*c*. side 76*c* approximate length 0.21 inch.

The invention claimed is:

1. A gutter shield device for mounting to a rain gutter attached to a building structure, the gutter shield device comprising:

an elongated body formed of a continuous sheet of material and comprising:

a first body portion configured to contact a top front lip of the rain gutter;

a second body portion configured to contact the building structure; and an intermediate body portion disposed between and integrally connected to the first and second body portions by first and second folded portions defining respective receiving channels, the intermediate body portion defining a water receiving area including a plurality of openings; and a micro mesh filtering membrane extending over the water receiving area of the intermediate body portion, wherein lateral edges of the filtering membrane are received in the first and second receiving channels.

2. The gutter shield device of claim 1, wherein the elongated body includes at least one upwardly extending water directing element arranged adjacent to at least one of the openings, wherein the at least one water directing element contacts a bottom surface of the filtering membrane and directs water flowing across the gutter shield downwardly through the adjacent opening.

3. The gutter shield device of claim 1, wherein the micro mesh filtering membrane is formed from a metallic material.

4. The gutter shield device of claim 3, wherein the metallic material comprises stainless steel.

5. The gutter shield device of claim 4, wherein the micro mesh filtering membrane comprises a plurality of interwoven threads having a mesh of between approximately 80 and approximately 280.

6. The gutter shield device of claim 1, wherein the micro mesh filtering membrane comprises a plurality of interwoven threads having a mesh of between approximately 80 and approximately 280.

* * * * *